US006666715B2

(12) United States Patent
Fujita et al.

(10) Patent No.: US 6,666,715 B2
(45) Date of Patent: Dec. 23, 2003

(54) CONNECTOR AND METHOD FOR CONSTRUCTING A CONNECTOR

(75) Inventors: Shinya Fujita, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/205,147

(22) Filed: Jul. 24, 2002

(65) Prior Publication Data

US 2003/0036316 A1 Feb. 20, 2003

(30) Foreign Application Priority Data

Jul. 25, 2001 (JP) ..... 2001-224873

(51) Int. Cl.[7] ..... H01R 13/502
(52) U.S. Cl. ..... 439/540.1; 439/701
(58) Field of Search ..... 439/701, 540.1

(56) References Cited

U.S. PATENT DOCUMENTS 5,454,733 A * 10/1995 Watanabe et al. ..... 439/540.1
5,577,934 A * 11/1996 Yagi et al. ..... 439/540.1
5,882,225 A * 3/1999 Kee et al. ..... 439/540.1
6,332,788 B1 * 12/2001 Okabe et al. ..... 439/157
6,352,447 B1 * 3/2002 Ruth ..... 439/540.1
6,409,551 B1 * 6/2002 Nagai ..... 439/701

* cited by examiner

*Primary Examiner*—Gary Paumen
(74) *Attorney, Agent, or Firm*—Gerald E. Hespos; Anthony J. Casella

(57) ABSTRACT

Auxiliary connectors (6) of a female connector (1) are formed for a plurality of types of female terminal fittings (8). When a plurality of auxiliary connectors (6) of the same type are mounted into a frame (2), the number of the terminal fittings to be inserted into the individual auxiliary connector (6) is decided based on connection loads per terminal fitting to ensure that an operation load of the auxiliary connector (6) does not exceed an upper-limit value, and the same number of terminal chambers (7) as the decided number of the terminal fittings are formed in the auxiliary connector (6). Thus, regardless of the specifications of the female terminal fittings (8), the female terminal fittings (8) can be mounted into all the terminal chambers 7 without exceeding the upper-limit value of the operation load of the auxiliary connectors (6).

8 Claims, 1 Drawing Sheet

CONNECTOR AND METHOD FOR CONSTRUCTING A CONNECTOR

BACKGROUND OF THE INVENTION

1. Field of the Invention

The present invention relates to a connector and to a method for constructing a connector.

2. Description of the Related Art

Different types of connectors frequently are produced by accommodating different kinds of terminal fittings in connector housings of the same type. For example, terminal fittings for automotive connectors are selected according to specified current values for a particular vehicle type and grade. However connector housings of the same type may be used for any of several specifications.

An operation load for connecting female and male connectors is mainly the sum of the friction between female and male terminal fittings as they are connected and, to a lesser extent, the friction between the female and male connector housings. A connector usually is designed so that the operation load is in a range that enables the connectors to be connected manually. An operation load beyond this range requires the connecting force to be supplemented, for example, by utilizing a lever.

Different types of terminal fittings often have different connection loads that act between female and male terminal fittings. Thus, an operation load may be acceptable when terminal fittings of one type are used in the housings. However, the operation load may be exceeded if the housings are used with terminal fittings that have a higher connection load per piece. Accordingly an operation load set beforehand may be exceeded, and it may be difficult to connect the connector housings.

The present invention was developed in view of the above problem, an object thereof is to enable a smooth connector connecting operation regardless of a change in specification.

SUMMARY OF THE INVENTION

The invention is directed to a connector having a plurality of types of terminal fittings of different insertion or connection loads that act when female and male terminal fittings are connected. At least one type of mateable connector housings is provided. The connector housings are formed with terminal chambers corresponding to the respective types of the terminal fittings for accommodating the respective terminal fittings. An upper-limit value is set beforehand for an operation load that acts when each connector housing is connected with a mating connector housing while the terminal fittings are accommodated in the terminal chambers. Each of the various types of the connector housings is formed with the same number of the terminal chambers as the number of terminal fittings permitted in the connector housing based on the connection loads of the various types of the terminal fittings.

A plurality of types of terminal fittings having different connection loads per piece are selected in accordance with a required specification and are accommodated in the terminal chambers of the connector housing. However, the number of the terminal chambers is decided to ensure that the sum of the individual connection loads of the respective accommodated terminal fittings does not exceed the upper-limit value of the operation load set beforehand for this connector housing. By setting the number of the terminal chambers in this way, the respective terminal fittings can be accommodated into all the terminal chambers formed therefor without exceeding the upper-limit value of the operation load of the connector housing, regardless of the specification of the connector housing. Thus, operability in connecting the connector housings is not degraded.

The connector may be a divided connector with a plurality of auxiliary connectors formed by the various types of connector housings. A frame may be formed with a plurality of housing chambers for accommodating any of the various types of the auxiliary connectors.

An upper-limit value of an operation load that acts when the entire divided connector and a mating connector are connected with the terminal fittings accommodated preferably is set beforehand. Each of the various types of the auxiliary connectors is formed with the same number of the terminal chambers as the terminal fittings permitted into the auxiliary connector based on the connection loads of the various types of the terminal fittings within such a range that an operation load of the auxiliary connector does not exceed an upper-limit value of the operation load permitted per housing chamber.

The upper-limit value of the operation load permitted per housing chamber preferably is obtained by dividing the upper-limit value of the operation load of the entire divided connector by the number of the housing chambers.

The sum of the connection loads of the individual auxiliary connectors accommodated in the housing chambers becomes the operation load of the entire divided connector. Accordingly, the number of the terminal fittings accommodated in the housing chamber is decided based on the connection loads of the respective terminal fittings to ensure that the upper-limit value per housing chamber in the frame is not exceeded, and the same number of the terminal chambers as the decided number of the terminal fittings are formed in the auxiliary connector. Accordingly, the upper-limit value of the connection load of the auxiliary connector is not exceeded. In other words, the sum of the connection loads of the auxiliary connectors in the housing chambers does not exceed the upper-limit value of the operation load of the divided connector. Thus, connection operability with the mating connector is not degraded.

The invention also is directed to a method for constructing or designing a connector. The method comprises defining or providing a plurality of types of terminal fittings having different connection or mating loads per pair that act when a female and male terminal fitting are connected with each other. The method then comprises providing or defining at least one type of connector housing formed with terminal chambers corresponding to the respective type of the terminal fittings for accommodating the respective terminal fittings. The method continues by setting or obtaining beforehand an upper-limit value of an operation load that acts when each connector housing is connected with a mating connector housing with the terminal fittings accommodated in the terminal chambers. The method proceeds by providing each of the various types of the connector housings with the same number of the terminal chambers as the number of terminal fittings permitted in the connector housing based on the connection loads of the various types of the terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

Figure 1:
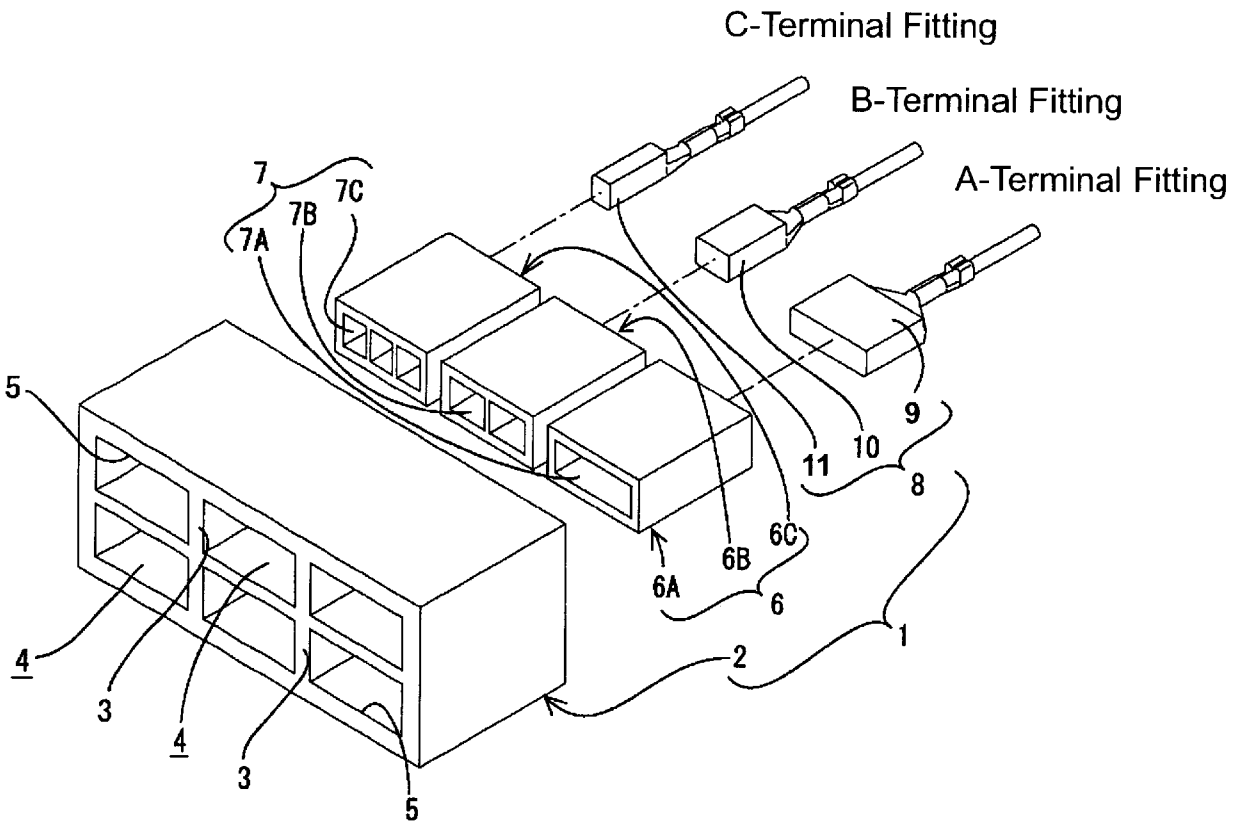
FIG. 1 is a perspective view of a female connector according to one preferred embodiment of the invention.

A divided female connector, in accordance with the invention, is identified by the numeral 1 in FIG. 1, and has a frame 2 with a plurality of partition walls 3 that define chambers 4. Auxiliary connectors 6 are inserted into the chambers 4 from behind, and are locked by unillustrated lock mechanisms. Each auxiliary connector 6 has terminal chambers 7 for accommodating female terminal fittings 8. The frame 2 is connectable with a male connector, and male terminal fittings are connectable with the female terminal fittings 8 in the respective auxiliary connectors 6 when the frame 2 and the male connector are connected.

This embodiment has three types of the female terminals A, B, C to be accommodated in the auxiliary connectors 6, and each type of female terminal fittings 8 has its own specified connection load. The connection or mating load is the load or force necessary for the connecting the female terminal fitting(s) with the male terminal fitting(s). Auxiliary connectors 6A, 6B, 6C are provided specially for the respective types of female terminal fittings 8 according to the connection loads. All types of auxiliary connectors 6 can be accommodated in the housing chambers 4. Thus, the frame 2 is used for all of the respective auxiliary connectors 6. In this embodiment, the same types of auxiliary connectors 6 are accommodated in the frame 2 in accordance with a required specification.

Generally, in designing a connector, an upper-limit value of the connection load necessary to connect female and male connectors is known and the number of contacts is set so as not to exceed this known upper-limit value. If the connector is designed without regard for this upper-limit value, a connecting operation by human hands is made difficult and a connection assisting means, such as a lever, needs to be provided if the upper-limit value is exceeded. However, the operation load necessary for the divided connector of this embodiment to connect with the male connector is a sum of the operation loads of the respective auxiliary connectors, which a sum of an inter-housing friction force acting between the frame and the male connector and the total of friction forces acting between all pairs of female and male terminal fittings. This sum is compared with the upper-limit value in the case of the divided connector.

However, all the auxiliary connectors 6 to be accommodated in all the housing chambers 4 of the frame 2 are of the same type in this embodiment. Therefore, it is sufficient to consider the operation load in the individual housing chamber 4, i.e. the operation load of the individual auxiliary connector 6. In addition, it is known empirically that the sum of the friction forces acting between the female and male terminal fittings is by far larger than the friction force acting between the frame and the male connector. Accordingly, the friction force between the frame and the male connector is disregarded to facilitate the following description. Under these conditions, the upper-limit value of the respective auxiliary connectors 6 is set at 12 Newton (N) if the upper-limit value set for the entire divided connector is 72N.

This embodiment assumes that A-terminal fittings 9 have a connection load of 12N per piece, B-terminal fittings 10 have a connection load of 6N per piece, and C-terminal fittings 11 have a connection load of 4N per piece. Then, the number of the terminal chambers 7 formed based on the number of the female terminal fittings 8 to be permitted into each auxiliary connector 6 is determined to ensure that the operation load of the auxiliary connector 6 should exceed the upper-limit value 12N.

The upper-limit value of the operation load of the auxiliary connector 6A is 12N. Therefore, only one A-terminal fitting 9 is permitted into the auxiliary connector 6A since the connection load of the A-terminal fitting 9 is 12N per piece and only one terminal chamber 7A is formed in the auxiliary connector 6A as shown in TABLE-1. Thus, the operation load of this auxiliary connector 6A is 12N. Similarly, two of the B-terminal fittings 10 are permitted and, accordingly, two terminal chambers 7B are formed. The sum of the connection loads of the two B-terminal fittings 10 inserted into the two terminal chambers 7B is 12N and defines the operation load of the auxiliary connector 6B. Three C-terminal fittings 11 are permitted and, accordingly, three terminal chambers 7C are formed. Thus, the operation load is 12N when the C-terminal fittings 11 are inserted into the three terminal chambers 7C. When the three types of the female terminal fittings are mounted as above, the operation load is constantly 12N in the auxiliary connector 6 of any specification. In other words, if $L_{max,i}$ is the maximum permissible (upper-limit) value of the operation load of the auxiliary connector $C_i$ when connected with a mating auxiliary connector and $L_{TF,i}$ is the connection load of each single terminal fitting TF to be accommodated in the specific auxiliary connector $C_i$, the maximum permissible number of terminal fittings TF to be accommodated in the specific auxiliary connector $C_i$ is:

$$n_{\max\ i} = {}_{int}\left[\frac{L_{\max,i}}{C_i}\right]$$

wherein int[x] represents the integer part of x∈R which is the integer truncation of x∈R (e.g. int[2.83]=2). For a divided connector having a plurality of auxiliary connectors, when the maximum value $L_{max}$ of the connection load needed to mate the full divided connector with a mating connector, the maximum permissible (upper-limit) value $L_{max,i}$ of connection load of the auxiliary connector $C_i$ is:

$$L_{\max,i} = \frac{L_{\max}}{N_{HC}}$$

where $N_{HC}$ is the number of housing chambers 4 in the divided connector for at least partly accommodating the respective auxiliary connectors.

TABLE 1

| (1) | (2) | (3) | (4) |
|---|---|---|---|
| A-TERMINAL FITTING | 12 | 1 | 12 |
| B-TERMINAL FITTING | 6 | 2 | 12 |
| C-TERMINAL FITTING | 4 | 3 | 12 |

(1) type of terminal fitting
(2) insertion or connection load or force (in Newton) per terminal fitting
(3) number of terminal chambers formed in auxiliary connector
(4) total insertion or connection load or force (in Newton) when terminal fittings are inserted into all terminal chambers.

The number of the terminal chambers 7 to be formed is decided based on a relationship between the connection load per female terminal fitting 8 and the upper-limit value of the operation load of the auxiliary connectors 6. Thus, the respective female terminal fittings 8 can be mounted into all the formed terminal chambers 7 regardless of their specifications without exceeding the upper-limit value of the auxiliary connectors 6. The operation load of the entire female connector 1, which is an aggregate of these, does not exceed an upper-limit value set therefor regardless of the specification of the female connector 1, the connection operability of the female and male connectors is not degraded.

The three types of the auxiliary connectors 6 have the same operation load as described above. Accordingly, even if the auxiliary connectors 6 of three different specifications are mounted into the housing chambers 4, the connection load is distributed substantially uniformly in the entire female connector 1 since the respective auxiliary connectors 6 have the same operation load. As a result, a smooth connecting operation can be performed.

Accordingly, auxiliary connectors 6 of a female connector 1 are formed specially for female terminal fittings 8 of three kinds of specifications: A-terminal fittings 9, B-terminal fittings 10 and C-terminal fittings 11 to connect the connectors smoothly regardless of a change in specification. When a plurality of auxiliary connectors 6 of only the same type are mounted into a frame 2, the number of the terminal fittings to be inserted into the individual auxiliary connector 6 is decided based on connection loads per terminal fitting to ensure that an operation load of the auxiliary connector 6 does not exceed an upper-limit value, and the same number of terminal chambers 7 as the decided umber of the terminal fittings are formed in this auxiliary connector 6. Thus, regardless of the specifications of the female terminal fittings 8, the female terminal fittings 8 can be mounted into all the terminal chambers 7 without exceeding the upper-limit value of the operation load of the auxiliary connectors 6. Since an upper-limit value set for the entire female connector 1 is not exceeded, connection operability is not degraded.

The present invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The present invention is applicable not only to the divided connector of the foregoing embodiment, but also to single-piece connectors or block-type connectors not using the frame 2.

What is claimed is:

1. A connector, comprising:

a plurality of types of terminal fittings (9–11) having different connection loads ($L_{TF,i}$) per pair which act when the pair of female and male terminal fittings are connected with each other, and a plurality of types of connector housings (6A–6C) formed with at least one terminal chamber (7A–7C) corresponding to the respective type of the terminal fittings (9–11) for accommodating the respective terminal fittings (9–11), wherein an upper-limit value ($L_{max,i}$) of an operation load which acts when each connector housing (6A–6C) is connected with a mating connector housing with the terminal fittings (9–11) at least partly accommodated in the terminal chambers (7A–7C) is set beforehand, and each of the various types of the connector housings (6A–6C) is formed with the same number of the terminal chambers (7A–7C) as the number of terminal fittings (9–11) permitted into the connector housing (6A–6C) based on the connection loads ($L_{TF,i}$) of the various types of the terminal fittings (9–11).

2. The connector of claim 1, wherein the connector is a divided connector comprising a plurality of auxiliary connectors (6A–6C) formed by the various types of connector housings (6A–6C), and a frame (2) formed with a plurality of housing chambers (4) for accommodating any of the various types of the auxiliary connectors (6A–6C).

3. The connector of claim 2, wherein an upper-limit value ($L_{max}$) of an operation load which acts when the entire divided connector and a mating connector are connected with the terminal fittings (9–11) accommodated is set beforehand, and each of the various types of the auxiliary connectors (6A–6C) is formed with the same number of the terminal chambers (7A–7C) as the terminal fittings (9–11) permitted into the auxiliary connector (6A–6C) based on the connection loads ($L_{TF,i}$) of the various types of the terminal fittings (9–11) within such a range that an operation load of the auxiliary connector (6A–6C) does not exceed an upper-limit value ($L_{max,i}$) of the operation load permitted per housing chamber (7).

4. The connector of claim 3, wherein the upper-limit value ($L_{max,i}$) of the operation load permitted per housing chamber (7) is obtained by dividing the upper-limit value ($L_{max}$) of the operation load of the entire divided connector by the number of the housing chambers (4).

5. A method for constructing a connector, comprising:

providing a plurality of types of terminal fittings (9–11) having different connection loads ($L_{TF,i}$) per pair which act when the pair of female and male terminal fittings are connected with each other, and providing a plurality of types of connector housings (6A–6C) formed with at least one terminal chamber (7A–7C) each corresponding to the respective type of the terminal fittings (9–11) for accommodating the respective terminal fittings (9–11), setting beforehand an upper-limit value ($L_{max,i}$) of an operation load which acts when each connector housing (6A–6C) is connected with a mating connector housing with the terminal fittings (9–11) accommodated in the terminal chambers (7A–7C), and providing each of the various types of the connector housings (6A–6C) with the same number of the terminal chambers (7A–7C) as the number of terminal fittings (9–11) permitted into the connector housing (6A–6C) based on the connection loads ($L_{TF,i}$) of the various types of the terminal fittings (9–11).

6. The method of claim 5, wherein the connector is a divided connector comprising a plurality of auxiliary connectors (6A–6C) formed by the various types of connector housings (6A–6C), and a frame (2) formed with a plurality of housing chambers (4) for at least partly accommodating any of the various types of the auxiliary connectors (6A–6C).

7. The method of claim 6, wherein an upper-limit value ($L_{max}$) of an operation load which acts when the entire divided connector and a mating connector are connected with the terminal fittings (9–11) accommodated is set beforehand, and each of the various types of the auxiliary connectors (6A–6C) is formed with the same number of the terminal chambers (7A–7C) as the terminal fittings (9–11) permitted into the auxiliary connector (6A–6C) based on the connection loads ($L_{TF,i}$) of the various types of the terminal fittings (9–11) within such a range that an operation load of the auxiliary connector (6A–6C) does not exceed an upper-limit value ($L_{max,i}$) of the operation load permitted per housing chamber (7).

8. The method of claim 7, wherein the upper-limit value ($L_{max,i}$) of the operation load permitted per housing chamber (7) is obtained by dividing the upper-limit value ($L_{max}$) of the operation load of the entire divided connector by the number of the housing chambers (4).

* * * * *